US009146050B2

(12) United States Patent
Jeong

(10) Patent No.: US 9,146,050 B2
(45) Date of Patent: Sep. 29, 2015

(54) REFRIGERATOR AND ICE MAKER WITH ROTATABLE ICE TRAYS

(75) Inventor: Gyuyeon Jeong, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 256 days.

(21) Appl. No.: 13/817,583

(22) PCT Filed: Aug. 2, 2011

(86) PCT No.: PCT/KR2011/005668
§ 371 (c)(1),
(2), (4) Date: Mar. 28, 2013

(87) PCT Pub. No.: WO2012/023717
PCT Pub. Date: Feb. 23, 2012

(65) Prior Publication Data

US 2013/0192292 A1 Aug. 1, 2013

(30) Foreign Application Priority Data

Aug. 19, 2010 (KR) ..... 10-2010-0080083

(51) Int. Cl.
*F25C 1/22* (2006.01)
*F25C 1/00* (2006.01)
(Continued)

(52) U.S. Cl.
CPC ... *F25C 1/24* (2013.01); *F25C 1/04* (2013.01); *F25C 5/02* (2013.01); *F25C 5/18* (2013.01); *F25C 2305/022* (2013.01); *F25C 2400/10* (2013.01); *F25D 23/04* (2013.01)

(58) Field of Classification Search
CPC ..... F25C 1/24; F25C 1/10; F25C 5/02; F25C 2400/10; F25C 2305/022
USPC ..... 62/345, 66, 71, 340, 350
See application file for complete search history.

(56) References Cited

U.S. PATENT DOCUMENTS 8,459,057 B2 * 6/2013 Kim et al. ..... 62/344
2002/0014087 A1 * 2/2002 Kwon ..... 62/340
(Continued)

FOREIGN PATENT DOCUMENTS

CN 1719164 A 1/2006
CN 101231090 A 7/2008
(Continued)

OTHER PUBLICATIONS

PCT International Search Report dated Mar. 12, 2012 for Application No. PCT/KR2011/005668, 3 pages.
(Continued)

*Primary Examiner* — Cassey D Bauer
*Assistant Examiner* — Joseph Trpisovsky
(74) *Attorney, Agent, or Firm* — Fish & Richardson P.C.

(57) ABSTRACT

Provided is a refrigerator. The refrigerator includes a cabinet defining a refrigerating compartment and a freezing compartment, a freezing compartment door opening or closing the freezing compartment, and an ice making device disposed on a rear surface of the freezing compartment door. The ice making device includes a case disposed on the freezing compartment door, an ice tray rotatably disposed inside the case, the ice tray making an ice therein, a knob exposed to the outside of the case, the knob being connected to a rotation shaft of the ice tray and rotated by being manipulated from the outside, and an elastic member disposed on the rotation shaft of the ice tray, the elastic member providing an elastic force into the ice tray so that the ice tray is rotated to an original position. Thus, a structure for rotating the ice tray may be simplified.

12 Claims, 7 Drawing Sheets

(51) Int. Cl.

| | |
|---|---|
| ***F25C 5/02*** | (2006.01) |
| ***F25C 1/24*** | (2006.01) |
| ***A23G 9/00*** | (2006.01) |
| ***F25C 5/18*** | (2006.01) |
| ***F25C 1/04*** | (2006.01) |
| *F25D 23/04* | (2006.01) |

(56) References Cited

U.S. PATENT DOCUMENTS

| | | | | |
|---|---|---|---|---|
| 2005/0241329 | A1* | 11/2005 | Castrellon et al. | 62/340 |
| 2007/0089441 | A1* | 4/2007 | Ito et al. | 62/135 |
| 2009/0178431 | A1* | 7/2009 | Cho | 62/345 |

FOREIGN PATENT DOCUMENTS

| | | | |
|---|---|---|---|
| CN | 101529176 | A | 9/2009 |
| JP | 2001-116410 | A | 4/2001 |
| KR | 2003-0038994 | A | 5/2003 |
| KR | 2009-0125318 | A | 12/2009 |

OTHER PUBLICATIONS

Chinese Office Action and Search Report dated Jul. 3, 2014 for Chinese Application No. 2011800401590, with English Translation, 16 pages.

* cited by examiner

Fig. 5
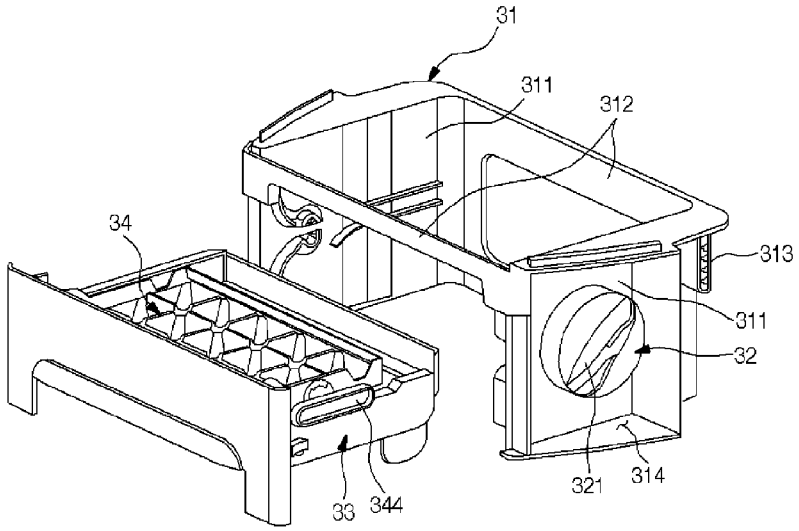
Fig. 6]
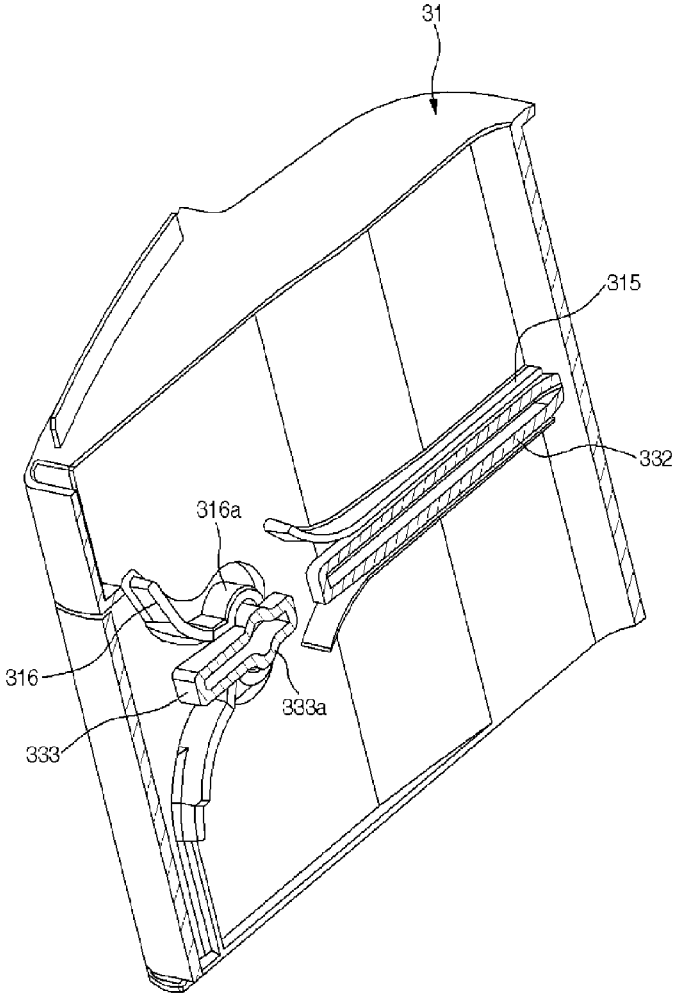

REFRIGERATOR AND ICE MAKER WITH ROTATABLE ICE TRAYS

CROSS REFERENCE TO RELATED APPLICATIONS

This application is a U.S. National Phase Application under 35 U.S.C. §371 of International Application PCT/KR2011/005668, filed on Aug. 2, 2011, which claims the benefit of Korean Application No. 10-2010-0080083, filed on Aug. 19, 2010, the entire content of each of the prior applications is hereby incorporated by reference.

TECHNICAL FIELD

The present disclosure relates to a refrigerator.

BACKGROUND ART

A refrigerator is a home appliance providing a low-temperature storage that can be opened and closed by a door for storing foods at a low temperature. For this, the refrigerator cools the inside of the storage space using cool air generated by heat-exchanging with a refrigerant that circulates a cooling cycle to store the foods in an optimum state.

The size of the refrigerator tends to increase more and more and multi-functions are provided to the refrigerator as dietary life changes and pursues high quality, and accordingly, refrigerators of various structures with consideration of user convenience and energy efficiency are brought to the market.

Specifically, as demands of ice increase, an ice making device having various and convenient structures in the refrigerator are being developed.

DISCLOSURE OF INVENTION

Technical Problem

Embodiments provide a refrigerator including an ice making device which is convenient in use and maintained in a stable mounting state.

Solution to Problem

In one embodiment, a refrigerator includes: a cabinet defining a refrigerating compartment and a freezing compartment; a freezing compartment door opening or closing the freezing compartment; and an ice making device disposed on a rear surface of the freezing compartment door, wherein the ice making device includes: a case disposed on the freezing compartment door; an ice tray rotatably disposed inside the case, the ice tray making an ice therein; a knob exposed to the outside of the case, the knob being connected to a rotation shaft of the ice tray and rotated by being manipulated from the outside; and an elastic member disposed on the rotation shaft of the ice tray, the elastic member providing an elastic force into the ice tray so that the ice tray is rotated to an original position.

The case may be disposed on a door dike protruding from both left and right sides of the rear surface of the freezing compartment door, and at least portion of the case may protrude forward from the door dike.

The knob may be disposed at a front side of the door dike.

A mounting part may be disposed on an inner surface of the door dike, and a case mounting part coupled to the mounting part may be disposed on each of both left and right sides of the case to allow the case to be detachably disposed on the freezing compartment.

The ice tray may be accessibly disposed on the case, and when the ice tray may be inserted into the case, the ice tray is cooperably coupled to the knob.

The knob may include: a manipulation part disposed outside the case, the manipulation part being rotated by a user; and a rotation plate in which at least portion thereof passes through the case and is coupled to the manipulation part, thereby being rotated together with the manipulation part, the rotation plate being disposed inside the case.

A tray connection part may be disposed on a rotation shaft of the ice tray, and a second guide part coupled to the tray connection part when the ice tray is mounted may be further disposed on the knob.

A protruding restriction projection may be disposed on the rotation plate, and a rotation plate restriction part restricting the restriction projection to maintain a position at which the knob is coupled to the ice tray may be further disposed on the case.

The refrigerator may further include a mounting case in which the ice tray is rotatably disposed, the mounting case being accessibly disposed inside the case.

A first guide part in which a guide projection protruding from a side surface of the mounting frame is slidably inserted may be disposed on an inner surface of the case facing the knob.

The mounting plate may be disposed at a front side of the first guide part to pass through the first guide part, and a first fixing part in which a fixing protrusion protruding from one side surface thereof is fitted may be further disposed on the mounting plate.

The first fixing part may have a width gradually decreasing from an inlet thereof to an outlet.

A rotation shaft of the ice tray may be disposed on a front side of the knob to pass through the knob, and a second fixing part to which a second fitting part is protruding from one side surface thereof is closely attached and fixed may be further disposed on the mounting plate.

The refrigerator may further include a second guide part disposed at a rear side of the second fixing part to insert the rotation shaft of the ice tray passing through the second fixing part therein on the knob.

A first guide part for guiding insertion of a side of the mounting case when the mounting case is mounted may be disposed on the case, and a second guide part for guiding insertion of a side of the rotation shaft of the ice tray when the mounting case is mounted may be disposed on the knob.

Advantageous Effects of Invention

According to embodiments, the following effects can be attained.

First, the knob may be disposed on a side of the case on which the door dike is disposed to expose the knob to the outside. Thus, the knob may be easily accessible and manipulated.

Second, since the knob is directly manipulated to rotate the ice tray, a separate gear structure may be unnecessary. Thus, the assembling process may be easy and manufacturing costs may be reduced.

Third, the first and second guide parts for guiding the take in/out of the mounting frame when the mounting frame is inserted may be provided. Also, the first and second fixing parts for restricting the mounting frame when the mounting frame is completely inserted may be provided. Thus, the mounting frame may be more stably mounted.

Fourth, the restriction projection may be disposed on the rotation restriction part to locate the rotation plate in position. Thus, the mounting frame may be more easily mounted.

BRIEF DESCRIPTION OF DRAWINGS

FIG. 5 is an exploded perspective view of the ice making device when viewed from one side.

FIG. 6 is a sectional view taken along line 6-6' of FIG. 3.

MODE FOR THE INVENTION

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
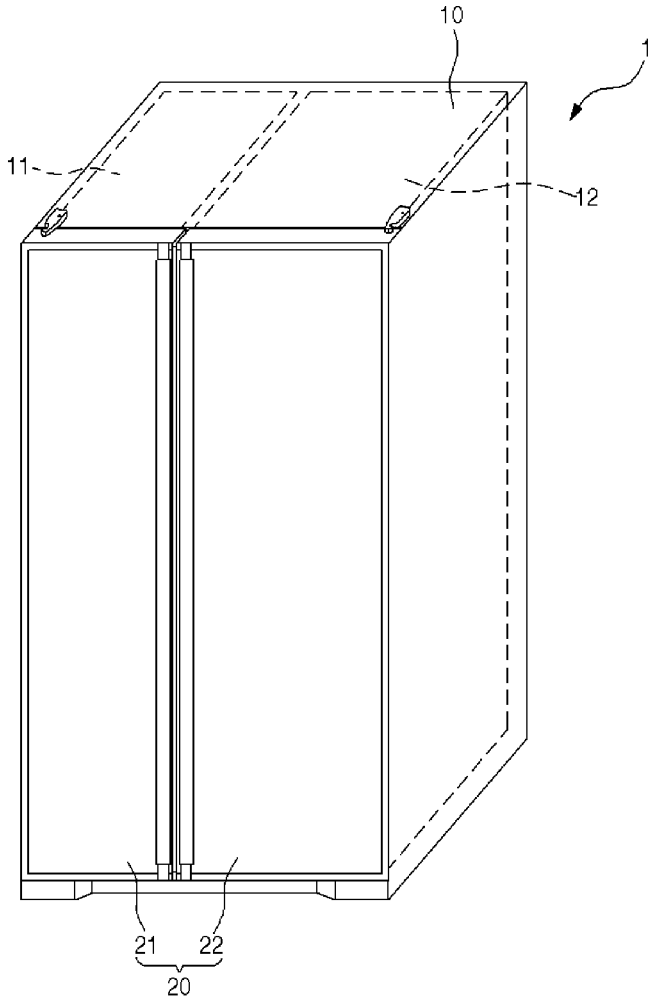
FIG. 1 is a perspective view of a refrigerator according to an embodiment.

FIG. 1 is a perspective view of a refrigerator according to an embodiment.

Referring to FIG. 1, a refrigerator 1 according to an embodiment includes a cabinet 10 defining a storage space and a door 20 which is openably or closably disposed on the cabinet 10. An outer appearance of the refrigerator 1 may be defined by the cabinet 100 and the door 20.

The inside of the cabinet 10 is partitioned into left and right sides to define a refrigerating compartment 10 at the left side and a freezing compartment 12 at the right side. A plurality of shelves and drawers are disposed inside the freezing compartment 12 and the refrigerating compartment 11 to receive foods.

The door 200 may include a freezing compartment door 21 and a refrigerating compartment door 22 which respectively open or close the freezing compartment 21 and the refrigerating compartment 22. The freezing compartment door 21 and the refrigerating compartment door 22 are rotatably disposed on the cabinet 10 to open or close the refrigerating compartment 12 and the freezing compartment 10 by their rotation.

Figure 2:
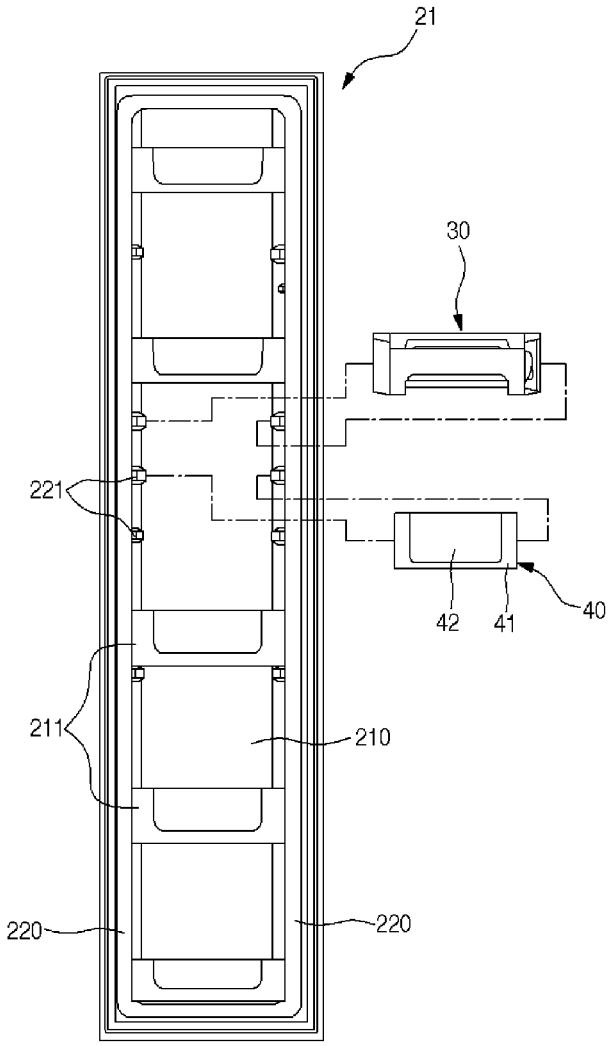
FIG. 2 is a rear view of a freezing compartment door according to an embodiment.

FIG. 2 is a rear view of a freezing compartment door according to an embodiment.

A plurality of baskets 211 may be disposed on a rear surface of the freezing compartment door 21. The rear surface of the freezing compartment door 21 may be defined by a door liner 210. A protruding door dike 220 may be disposed on each of both left and right sides of the rear surface of the freezing compartment door 21. The door dike 220 may extend in a vertical direction. A mounting part 221 coupled to both left and right side surfaces of the plurality of baskets 211 to mount the baskets may protrude from an inner surface of the door dike 220. The mounting part 221 may be vertically provided in plurality to mount the baskets at desired positions. That is, the plurality of baskets 211 may be mounted at various positions by the various combinations of the plurality of mounting parts 221.

An ice making device 30 and an ice storage device 30 may be detachably disposed on the rear surface of the freezing compartment door 21. The ice making device 30 and the ice storage device 40 may be disposed on the mounting parts 221, like the plurality of baskets 211. Also, the mounting positions of the ice making device 30 and the ice storage device 40 may be decided according to the positions of the mounting parts 221.

The ice making device 30 may receive supplied water to make ices. Here, the ices made by the manipulation of a user may be transferred downward by the manipulation of the user. The ice storage device 40 may be disposed below the ice making device 30 to store the transferred ices. Also, the ice storage device 40 may have a structure similar to that of the accessible basket.

The ice storage device 40 may include a case detachably disposed on the door dike 220 and a storage basket 42 which is slidably accessible into the case 41 to store ices.

Hereinafter, the ice making device will be described in more detail.

Figure 4:
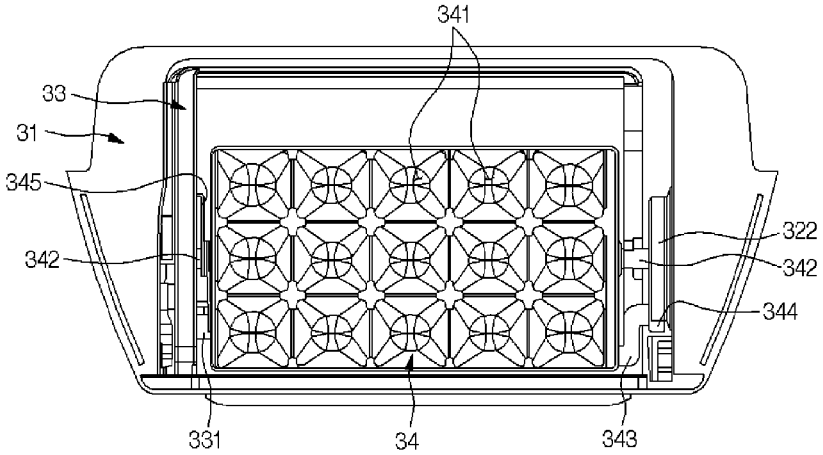
FIG. 4 is a plan view of the ice making device.

FIG. 4 is a plan view of the ice making apparatus. FIG. 5 is an exploded perspective view of the ice making apparatus when viewed from a side.

Referring to FIGS. 4 and 5, the ice making device 30 includes a case 31 disposed on the freezing compartment door 21, a mounting frame 33 on which the ice tray 34 is rotatably disposed, the mounting frame 33 being accessibly disposed on the case 31, the ice tray receiving water to make ices, and a knob 32 manipulated to rotate the ice tray 34.

In detail, the case 31 may include both left and right side surfaces 311 for receiving the mounting frame 33 and a connection part 312 for connecting rear and front ends of both left and right side surfaces 311 to each other. The most of connection part 312 may be opened to allow cool air to smoothly flow.

A rear end of the case 31 may be disposed inside the door dike 220 when the freezing compartment door 21 is mounted. A case mounting part 313 coupled to the mounting part 221 may be disposed on each of both left and right sides of the rear end of the case 31. The case mounting part 313 may have a shape corresponding to that of the mounting part 221. Also, the case mounting part 313 may be configured to move the case from an upper side to a lower side, thereby seating the case 31.

When the case 31 is mounted, a front end of the case 31 may be disposed at a front side of the door dike 220. Also, when the case 31 is mounted on the door dike 220, both left and right side surfaces 311 of the case 31 may be disposed on the same extension line as those of side surfaces of the door dike 220.

A knob mounting part 314 on which the knob 32 is mounted may be disposed on one side surface (the right side surface when viewed in FIG. 5) of the case 31. The knob mounting part 314 may be recessed inward. Also, the knob 32 may be disposed on the recessed inside of the knob mounting part 314. Also, the knob 32 may be mounted on the knob mounting part 314 so that the knob 32 is exposed to the outside of the knob mounting part 314. Thus, when the case 31 is mounted on the door dike 220, the knob 32 may be exposed laterally to be easily manipulated by the user.

The knob 32 may have a circular shape and rotatably disposed on a side surface of the case 31. The knob 32 may include a manipulation part 321 rotated by the user at the outside of the case and a rotation plate 322 coupled to the manipulation part 321 and rotated at the inside of the case 31. Also, the rotation plate 322 may be coupled to a side of the ice tray 34. Thus, the ice tray 34 may be rotated by the rotation operation of the knob 32.

The mounting frame 33 may be slidably and accessibly disposed inside the case 31. The mounting frame 33 may have a vertically opened square frame shape. Also, the mounting frame 33 may be received inside the case 31.

When the mounting frame 33 is mounted on the case 31, a front surface of the mounting frame 33 may define a portion of a front surface of the case 31. Thus, the case 31 and the mounting frame 33 may be mounted with sense of unity in a state where the mounting frame 33 is mounted. A handle to be grasped by the user when the mounting frame 33 is taken in/out may be further disposed on a front surface of the mounting frame 33.

A twisting projection 331 may be disposed on a side (left side when viewed in FIG. 4) of the inner surface of the mounting frame 33. The twisting projection 331 may be disposed at a front side of a rotation shaft 342 of the ice tray 34. The twisting projection 331 may protrude inward to twist the ice tray 34 when the ice tray 34 is rotated at about 180°, thereby dispensing the ices.

A structure for guiding the take in/out of the mounting frame 33 and fixing the mounting frame 33 may be disposed on each of left and right side surfaces of the outside and the inside of the mounting frame 33. The structure will be described below in more detail.

The ice tray 34 may have a plurality of cells 341 which receive water to make ices. The plurality of cells 341 may be continuously disposed in two rows or three rows. The ice tray 34 may be formed of a plastic material. When the user rotates the ice tray 34, the ice tray 34 may contact the twisting projection 331 to dispense ices within the cells 341.

The rotation shaft 342 may be disposed on each of both left and right sides of the ice tray 34. The rotation shaft 342 may be rotatably disposed on each of both left and right sides of the mounting frame 33. Here, at least one side of the rotation shaft 342 may pass through the ice tray 34.

An auxiliary connection part 343 may be further disposed on a side of the ice tray 34. The auxiliary connection part 343 may be disposed at a side away from the rotation shaft 342 to extend outward. The auxiliary connection part 343 may be bent several times. Also, the auxiliary connection part 343 may extend up to a position corresponding to that of an end of the rotation shaft 342. The rotation shaft 342 adjacent to the auxiliary connection part 343 may pass through the mounting frame 33 or be seated on the mounting frame 33 to stably support the ice tray 34 in a state where the ice tray 34 is mounted on the mounting frame 33.

An extending end of the auxiliary connection part 342 and an end of the rotation shaft 342 may be connected to each other to form a tray connection part 344. The tray connection part 344 may extend in front and rear directions. Also, the tray connection part 344 may be coupled to a second guide part (see reference numeral 323 of FIG. 7) of the knob. Thus, when the knob 32 is rotated, the ice tray 34 may be rotated because the second guide part 323 and the tray connection part 344 are connected to each other. Also, when the tray connection part 344 is rotated, the rotation shaft 342 and the auxiliary connection part 343 may be rotated at the same time to more effectively twist the ice tray 34 during the twisting of the ice tray 34.

An elastic member 345 may be disposed on a side of the left and right sides of the rotation shaft 342. The elastic member 345 may be a torsion spring wound on the rotation shaft 342. The elastic member 345 may have one end fixed to the mounting frame 33 and the other end fixed to the ice tray 34. Thus, when the ice tray 34 is rotated, the elastic member 345 may be elastically deformed. After the rotation of the ice tray 34 is completed, the ice tray 34 may be reversely rotated by a restoring force of the elastic member 345. Accordingly, the ice tray 34 may return to its original position, i.e., a horizontal shate.

Hereinafter, a structure for fixing the mounting frame will be described in more detail.

Figure 3:
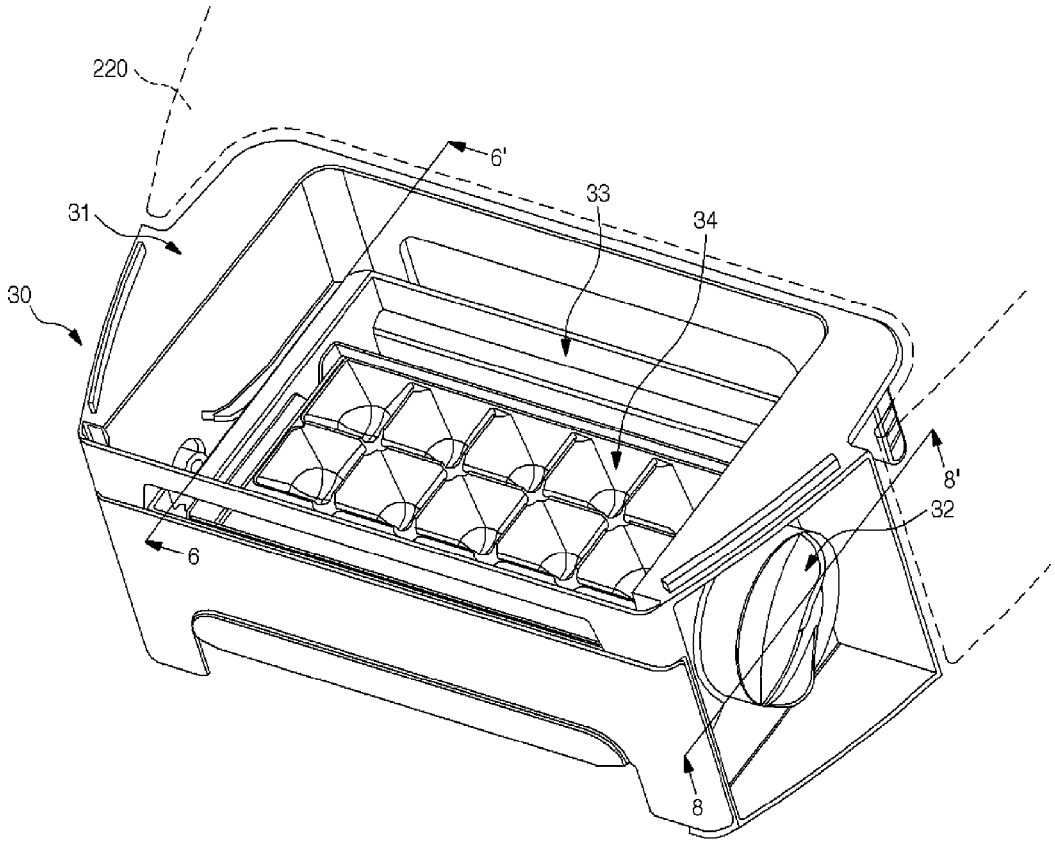
FIG. 3 is a perspective view of an ice making device according to an embodiment.
Figure 7:
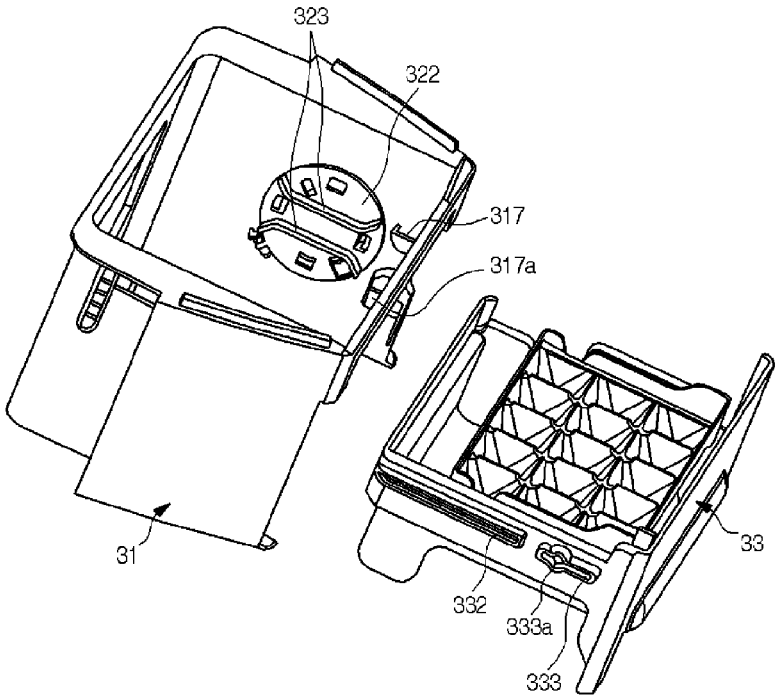
FIG. 7 is an exploded perspective view of the ice making device when viewed from the other side.
Figure 8:
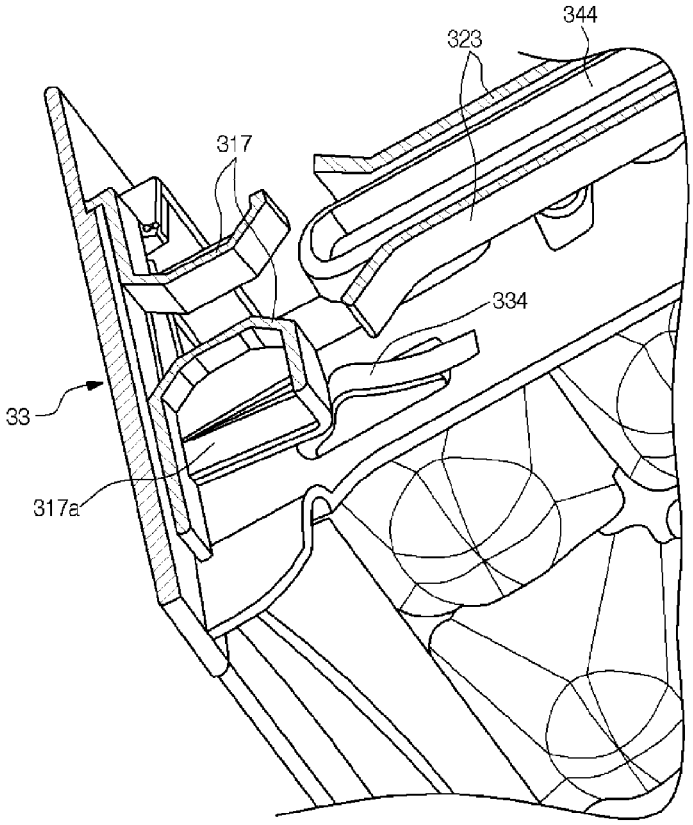
FIG. 8 is a sectional view taken along line 8-8' of FIG. 3.

FIG. 6 is a sectional view taken along line 6-6' of FIG. 3. FIG. 7 is an exploded perspective view of the ice making apparatus when viewed from the other side. FIG. 8 is a sectional view taken along line 8-8' of FIG. 3.

Referring to FIGS. 6 to 8, the first guide part 315 for guiding the taken in/out of the mounting frame 33 and a first fixing part 316 for fixing the mounting frame 33 may be disposed on a side surface (left side surface when viewed in FIG. 5) of the inside of the case 31. A guide projection 332 and a fixing projection 333 may be disposed on an outer surface of the mounting frame 33 to correspond to the first guide part 315 and the first fixing part 316.

In detail, the guide projection 332 may protrude laterally from a side surface of the mounting frame 33. Also, the guide projection 332 may extend backward from a position away from the fixing projection 333. The fixing projection 333 may be disposed on the front end of the case 31 to extend in front and rear directions. A fixing projection protrusion 333*a* which vertically protrudes may be disposed on the fixing projection 333. The fixing projection protrusion 333*a* may vertically protrude and have a rounded shape. Thus, the fixing projection 333 may be more easily moved when the fixing projection 333 is inserted into the first fixing part 316.

The first guide part 315 may receive the guide projection 332 to extend in front and rear direction when the mounting frame 33 is mounted. Also, the first guide part 315 may have a size corresponding to that of the guide projection 332. The first guide part 315 may protrude inward so as to receive the guide projection 332, thereby defining a space therebetween. The first guide part 315 may have a width gradually decreasing backward from an inlet thereof to easily insert the guide projection 332 therein.

The first fixing part 316 may receive the fixing projection 333 to extend from a front end of the side surface of the case 31 up to a front side of the first guide part 315. The first fixing part 316 may protrude inward so as to receive the fixing projection 333, thereby defining a space therebetween. A first fitting part 316*a* may be disposed on the first fixing part 316 to correspond to the fixing projection protrusion 333*a* when the mounting frame 33 is mounted. A first fitting part 316*a* may have a rounded shape corresponding to that of the first fixing part 316. Also, the first fitting part 316*a* may vertically protrude and be shapely coupled to the fixing projection protrusion 333*a*. Also, the first fixing part 316 may have a wide inlet. The first fixing part may have a predetermined curvature from an opened front end thereof up to the first fitting part 316*a*. Here, the first fixing part 316 may have a width gradually decreasing from the inlet. The first fixing part 316 may have an opened rear end. At least portion of a circumference of the first fixing part 316 may be cut to allow the first fixing part 316 to be vibrated when the fixing projection 333 is inserted.

Thus, when the mounting frame 33 is mounted outside the case 31, the guide projection 332 may pass through the first fixing part 316 and then be inserted into the first guide part 315. Here, the first fixing part 316 and the first guide part 315 may be disposed on the same extension line as each other to smoothly insert the guide projection 332. After the mounting frame 33 is inserted by a predetermined distance, the guide projection 333 may be guided into the first fixing part 316. When the mounting frame 33 is completely inserted, the fixing projection protrusion 333*a* is fitted into the first fitting part 316*a*. Thus, the mounting frame 33 may be firmly mounted inside the case 31.

A second fixing part 317 may be disposed on the other side surface (right side surface when viewed in FIG. 7) of the inside of the case 31. The second fixing part 317 may be disposed at the same height as that of the first fixing part 316 on a position opposite to that of the first fixing part 316. Also, the second fixing part 317 may be disposed at a height corresponding to that of the tray connection part 344. The second fixing part 317 may protrude inward from the case 31 to extend up to a front side of the knob 32. The second fixing part 317 may have front and rear ends having widths greater than that of a middle portion. When the mounting frame 33 is inserted, the tray connection part 344 may pass through the second fixing part 317.

An inclined surface 317*a* may be disposed at a side of a lower portion of the second fixing part 317. The inclined surface 317*a* may protrude from a front side to a rear side. When the mounting frame 33 is mounted, the inclined surface 317*a* may contact a second fitting part 334 disposed on a side surface of the mounting frame 33.

The second fitting part 334 may be disposed on the side surface of the mounting frame 33 corresponding to that of the inclined surface 317*a*. The second fitting part 334 may protrude outwardly. Also, the second fitting part 334 may have a central portion further protruding when compared to front and rear ends thereof. The second fitting part 334 may be rounded or inclined in front and rear direction with respect to a center thereof. Thus, when the mounting frame 33 is taken in/out, the second fitting part 334 may be easily hooked with the mounting frame 33. Also, the second fitting part 334 may have a circumference in which the most thereof is cut. Also, a large amount of second fitting part 34 may be away from a side surface of the mounting frame 33. Thus, when the second fitting part 334 contacts the second fixing part 317, the second fitting part 334 may be vibrated.

Thus, when the mounting frame 33 is inserted, the second fitting part 334 may be moved along the inclined surface 317*a* of the second fixing part 317. Then, as the mounting frame 33 is inserted, the second fitting part 334 may be gradually pressed. After the mounting frame 33 is completely inserted, the most protruding portion of the second fitting part 334 may pass over the inclined surface 317*a*. Then, the second fitting part 334 may be restored into its original shape, and thus hooked and restricted with the second fixing part 317. Thus, the mounting frame 33 may be maintained in a state it 33 is completely inserted.

A rotation plate 322 coupled to the knob 32 and rotated together with the knob 32 may be disposed at a rear side of the second fixing part 317. A second guide part 323 in which the tray connection part 334 is slidably inserted may be disposed on the rotation plate 322.

Hereinafter, a structure of the rotation plate will be described in more detail with reference to the accompanying drawings.

Figure 9:
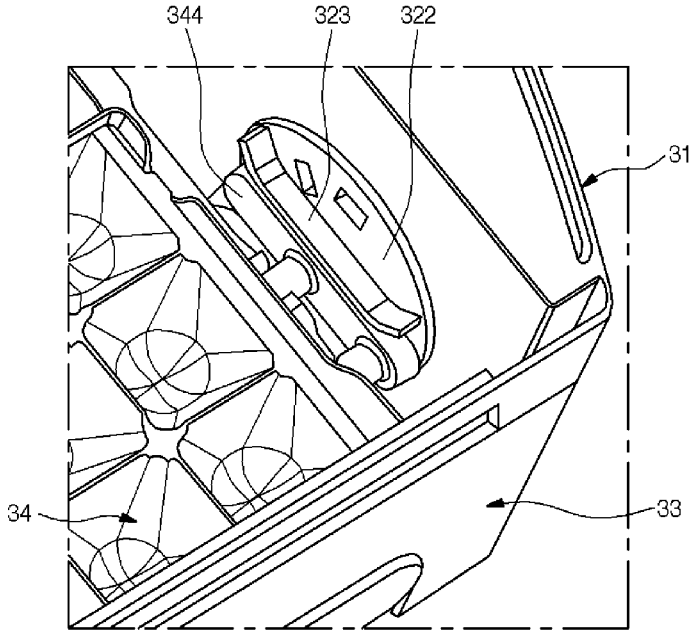
FIG. 9 is a view of a coupled state between an ice tray and a knob according to an embodiment.
Figure 10:
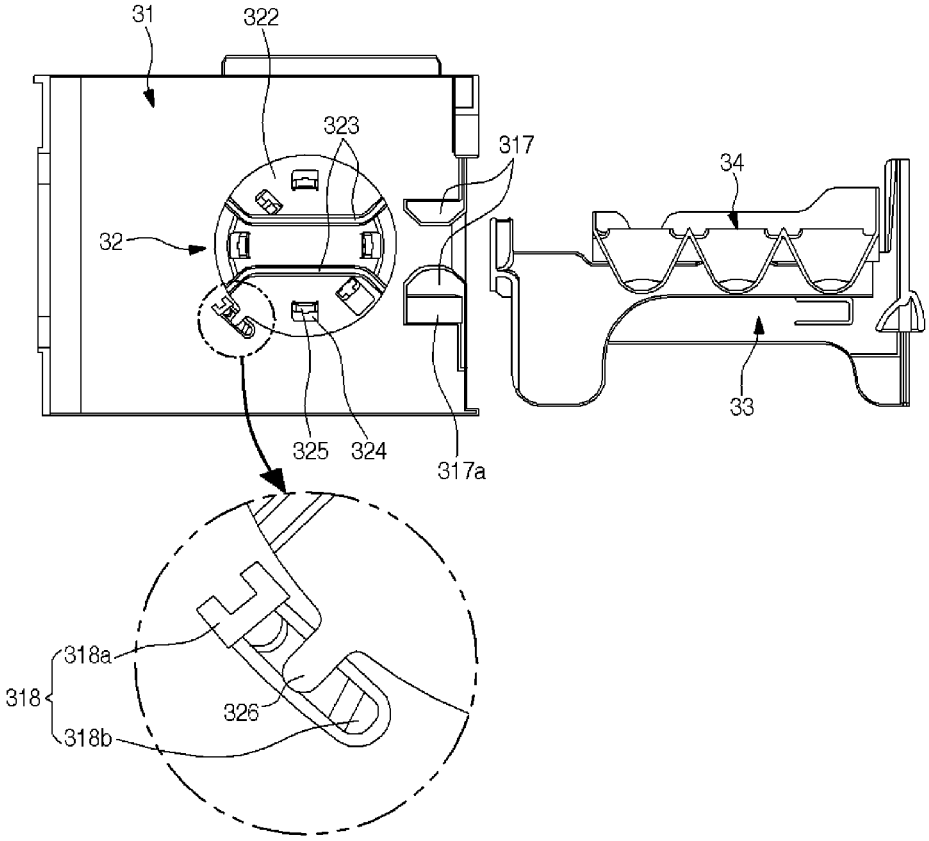
FIG. 10 is a view of a separated state between a case and a mounting frame according to an embodiment.
Figure 11:
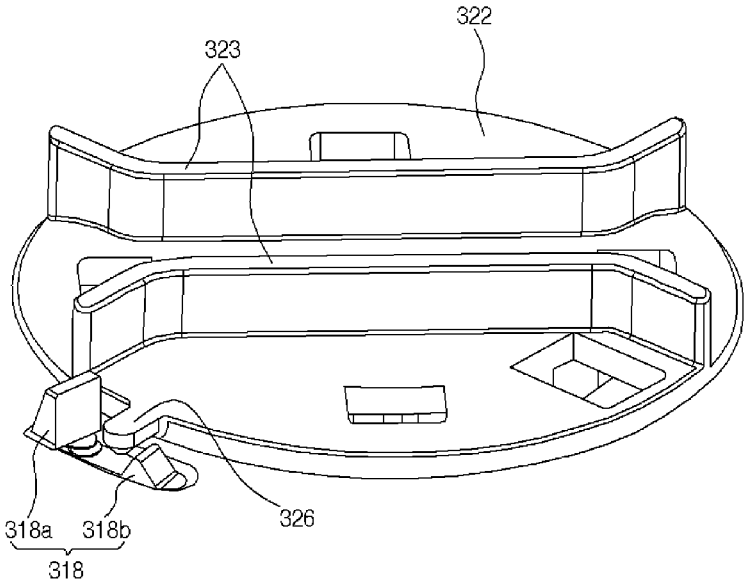
FIG. 11 is a view illustrating a restrained state of a knob according to an embodiment.

FIG. 9 is a view of a coupled state between an ice tray and a knob according to an embodiment. FIG. 10 is a view of a separated state between a case and a mounting frame according to an embodiment. FIG. 11 is a view illustrating a restrained state of a knob according to an embodiment.

Referring to FIGS. 9 and 11, a plurality of knob fixing holes 324 may be defined in the rotation plate 322. A knob coupling part 325 may be inserted into the knob fixing hole 324. Thus, the knob 32 and the rotation plate 322 may be rotated together with each other in a state where they are coupled to each other. That is, the rotation plate 322 may be rotated at the same angle as a rotation angle of the knob manipulated by the user.

A second guide part 323 which protrudes inwardly may be disposed on the rotation plate 322. The second guide part 323 may be disposed on each of upper and lower sides so as to receive the tray connection part 344, thereby defining a space therebetween. The second guide part 323 may be disposed at a position corresponding to that of the tray connection part 344 when the mounting frame 33 is completely inserted. The second guide part 323 may have an inlet and outlet which respectively have wide widths. Thus, the tray connection part 344 may be easily inserted.

Also, a restriction projection 326 which extends outward may be disposed on a side of the rotation plate 322. The restriction projection 326 may locate the rotation plate 322 in position. The restriction projection 326 may be restricted by a rotation plate restriction part 318 disposed on a side surface of the case 31.

The rotation plate restriction part 318 may be restricted with the restriction projection 326 when the rotation plate 322 is disposed in position so that an inlet of the second guide part 323 is disposed at a position corresponding to that of the opened rear end of the second fixing part 317.

In detail, the rotation plate restriction part 318 may include a rotation prevention stopper 318*a* which protrudes inward to prevent the restriction projection 326 from being further rotated in a clockwise direction (when viewed in FIG. 10) and a separation prevention stopper 318*b* extending forward from the rotation prevention stopper 318*a* and having the extending end protruding in a hook shape.

The most of circumference of the separation prevention stopper 318*b* may be cut. Thus, when restriction projection 326 is taken in/out, the separation prevention stopper 318*b* may be vibrated. A portion protruding from an end of the separation prevention stopper 318*b* may be inclined to smoothly move the restriction projection 326. When the restriction projection 326 is disposed between the rotation prevention stopper 318*a* and the separation prevention stopper 318*b*, the restriction projection 326 may not be randomly separated.

Thus, when the mounting frame 33 is mounted, the rotation plate 322 is disposed in position in a state where the restriction projection 326 is disposed on the rotation restriction part 318. Thus, the tray connection part 344 may be inserted into the second fixing part 317. In this state, when the knob 32 is operated, the ice tray 34 may be rotated together with the knob 32.

Hereinafter, operations of the ice making device including the above-described parts will be described.

First, to utilize the ice making device 30, the case 31 is disposed on the door dike 220. Then, water is filled into the ice tray 34. The mounting frame 33 on which the ice tray 34 is mounted is slidingly inserted into the case 31.

For this, the user manipulates the knob 32 to locate the restriction projection 326 on the rotation plate restriction part 318. As a result, the rotation plate 322 may be disposed in position. Next, the mounting frame 33 is pushed and inserted into the case 31.

Here, the guide projection 332 disposed on a side surface of both side surfaces of the mounting frame 33 passes through the first fixing part 316 and is inserted into the first guide part 315. Then, the guide projection 332 is moved along the inside of the first guide part 315. Simultaneously, the tray connection part 344 of the ice tray 34 passes through the second fixing part 317 and is inserted into the second guide part 323. When the mounting frame 33 is completely inserted, the guide projection 332 is disposed inside the first guide part 315. Also, the tray connection part 344 is disposed inside the second guide part 323.

Also, when the mounting frame 33 is completely inserted, the fixing projection 333 is disposed inside the first fixing part 316. Here, in the process in which the mounting frame 33 is inserted, the fixing projection protrusion 333*a* may be fitted into the first fitting part 316*a*.

Also, in the state where the mounting frame 33 is completely inserted, the second fitting part 334 may be hooked and restricted with the inclined surface 317*a* of the second fixing part 317. Here, the second fitting part 334 is moved along the inclined surface 317*a* in the process in which the mounting frame 33 is inserted. When the mounting frame 33 is completely inserted, the second fitting part 334 may pass over the inclined surface 317*a*, and thus be hooked and restricted. Thus, the mounting frame 33 may be maintained in a state the mounting frame 33 is fixed inside the case 31.

INDUSTRIAL APPLICABILITY

According to the embodiments, the structure for rotating the ice try may be simplified, and the ice tray may be stably and easily detachable, thereby improve industrial applicability.

The invention claimed is:

1. A refrigerator comprising:

a cabinet defining a refrigerating compartment and a freezing compartment;

a freezing compartment door that is configured to open or close the freezing compartment; and an ice making device located on a rear surface of the freezing compartment door, wherein the ice making device comprises:

a case located on the freezing compartment door, the case including:

a front surface having an access opening;

a rear surface having a case mounting part located at both side edges of the rear surface, the case mounting part configured to couple the case to a rear surface of the freezing compartment door; and two side surfaces connecting the front surface and the rear surface;

a knob rotatably coupled to one of the two side surfaces of the case, the knob configured to be exposed outside the ice making device, the knob including:

a rotation plate;

a manipulation part located at an outer surface of the rotation plate; and a guide part located at an inner surface of the rotation plate;

an ice tray removably and rotatably received inside the case, the ice tray including:

a tray body having a plurality of cells configured to receive water to make ice;

first and second rotation shafts each protruding from a respective side surface of the tray body;

a twisting projection protruding from a side surface of the tray body and separated from the first rotation shaft; and a tray connection part located at an end of the second rotation shaft and extending in a direction perpendicular to the second rotation shaft; and an elastic member located on the first rotation shaft of the ice tray and configured to provide an elastic restoring force to the ice tray so that the ice tray is rotated to an original position after being rotated, wherein the ice tray is received in the case through the access opening of the front surface of the case, wherein, based on the ice tray being received in the case, the tray connection part is coupled to the guide part of the knob, and the ice tray is configured to be rotated with the knob, and wherein the ice tray is separated from the case in a state in which the knob remains coupled to the one of the two side surfaces of the case.

2. The refrigerator according to claim 1, further comprising:

a door dike protruding from both left and right side edges of the rear surface of the freezing compartment door, and a mounting part to which the case mounting part is coupled.

3. The refrigerator according to claim 1, further comprising:

a restriction projection protruding from an edge of the rotation plate; and a rotation plate restriction part that is configured to restrict movement of the restriction projection, such that the guide part is configured to enable the tray connection part to be coupled to the guide part.

4. The refrigerator according to claim 1, further comprising a mounting frame in which the ice tray is rotatably coupled, the mounting frame being accessibly located inside the case.

5. The refrigerator according to claim 4, further comprising:

an additional guide part located at an inner surface of another of the two side surfaces of the case, the additional guide part including a pair of parallel ribs extending horizontally; and a guide projection protruding from a first side surface of the mounting frame and extending horizontally, the guide projection configured to be slidably received in a space between the pair of parallel ribs of the additional guide part.

6. The refrigerator according to claim 3, wherein:

the guide part includes a pair of parallel ribs that are located a predetermined distance from each other and extend in parallel to each other, and the tray connection part is configured to slide in a space between the pair of parallel ribs.

7. The refrigerator according to claim 5, further comprising:

a fixing projection protruding from the first side surface of the mounting frame and located in front of a front end of the guide projection; and a first fixing part located at the inner surface of the other of the two side surfaces of the case and in front of the additional guide part.

8. The refrigerator according to claim 7, further comprising:

a projecting part that vertically protrudes from the fixing projection; and a first fitting part located at the first fixing part, the first fitting part being configured to receive the projecting part and to restrict inadvertent movement of the mounting frame.

9. The refrigerator according to claim 7, further comprising a second fixing part formed at the one of the two side surfaces of the case and in front of a front end of the guide part, wherein the second fixing part is located at a height about even with the tray connection part, such that the tray connection part is configured to slide to pass through the second fixing part based on the mounting frame being inserted in the case.

10. The refrigerator according to claim 9, further comprising a second fitting part protruding from a second side surface of the mounting frame and configured to be compressed by a lower part of the second fixing part.

11. The refrigerator according to claim 1, wherein the tray connection part is longer than a diameter of the second rotation shaft.

12. The refrigerator according to claim 1, wherein based further on the ice tray being received in the case, the ice tray is configured to be singularly with the knob.

* * * * *